US007339545B2

(12) United States Patent
Su et al.

(10) Patent No.: US 7,339,545 B2
(45) Date of Patent: Mar. 4, 2008

(54) IMPEDANCE MATCHING MEANS BETWEEN ANTENNA AND TRANSMISSION LINE

(75) Inventors: Wen Fong Su, Tu-Chen (TW); Yun-Long Ke, Tu-Chun (TW); Yao-Shien Huang, Tu-Chun (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/159,983

(22) Filed: Jun. 22, 2005

(65) Prior Publication Data

US 2006/0103584 A1 May 18, 2006

(30) Foreign Application Priority Data

Nov. 18, 2004 (CN) ..... 2004 1 0065529

(51) Int. Cl.
*H01Q 1/50* (2006.01)
*H01Q 1/38* (2006.01)
*H01Q 21/12* (2006.01)

(52) U.S. Cl. ..... 343/860; 343/700 MS; 343/815

(58) Field of Classification Search ..... 343/700 MS, 343/846, 848, 815, 860
See application file for complete search history.

(56) References Cited

U.S. PATENT DOCUMENTS 5,173,715 A * 12/1992 Rodal et al. ..... 343/795
6,456,249 B1 * 9/2002 Johnson et al. ..... 343/702
6,870,507 B2 * 3/2005 Anguera Pros et al. ..... 343/700 MS

* cited by examiner

*Primary Examiner*—Shih-Chao Chen
(74) *Attorney, Agent, or Firm*—Wei Te Chung

(57) ABSTRACT

An impedance matching means according to the present invention is used with an antenna and is realized by a parasitic element (3) for tuning an impedance of the antenna. The antenna comprises a grounding plate (2), an radiating body (1) arranged on the grounding plate (2) and a transmission line (4) coupled to said radiating body (1) and grounding plate (2). The parasitic element (3) formed of a narrow metal sheet and configured as a bridge shape is arranged on the grounding plate (2). The parasitic element (3) has a first and a second ends (311, 321), both of which are electrically connected to the grounding plate (2). The arrangement of the parasitic element (3) results in a change of the impedance of the antenna, so the impedance matching between the antenna and the transmission line (4) can be achieved.

20 Claims, 6 Drawing Sheets

IMPEDANCE MATCHING MEANS BETWEEN ANTENNA AND TRANSMISSION LINE

BACKGROUND OF THE INVENTION

1. Field of the Invention

The present invention relates generally to an impedance matching means, and more particularly to an impedance matching means between an antenna and a transmission line.

2. Description of the Prior Art

In many RF situations, there is a relatively fixed load impedance—say a resonant antenna with a fixed impedance. A transmission line, such as a coaxial cable providing power energy to the antenna has its own characteristic impedance. In most cases when the energy reaches the end of the cable, we want as much as possible to transfer into our load—the antenna, in the case of a transmitter, or the input RF stage in the case of a receiver. For a transmitter this gives the highest power efficiency, while for a receiver this gives the best noise performance. To ensure this optimum energy transfer, we need to match the characteristic impedance of the cable to the impedance of the load. So for a 75 Ω antenna, we need to use 75 Ω cable. For a 50 Ω antenna we need to use 50 Ω cable, and so on. Impedance matching is critical factor in antenna assembly design. Because what happens if the transmission line and the antenna impedance are not matched is that some of the RF energy reaching the end of the transmission line cannot be transferred into the load, but is reflected back along the line towards the source. This can set up standing waves in the line and can also cause overheating in the transmitter output stage. In a receiver, the mismatch degrades the effective receiver gain and noise figure.

Hence, great attention is focused on the impedance matching by researchers in this field. Generally the cable impedance is more or less fixed, and the antenna impedance may be the same. So we need additional techniques to match the impedance of antenna with that of the cable.

BRIEF SUMMARY OF THE INVENTION

It is an object of the present invention to provide an impedance matching means to realize impedance matching between an antenna and a transmission line.

An impedance matching means according to the present invention is used with an antenna and is realized by a parasitic element for tuning an impedance of the antenna. The antenna comprises a grounding plate, a radiating body arranged on the grounding plate and a transmission line coupled to said radiating body and grounding plate. The parasitic element formed of a narrow metal sheet and configured as a bridge shape is arranged on the grounding plate. The parasitic element has a first and a second free ends, both of which are electrically connected to the grounding plate. The arrangement of the parasitic element results in a change of the impedance of the antenna, and especially its location can be tuned easily.

Additional novel features and advantages of the present invention will become apparent by reference to the following detailed description when taken in conjunction with the accompanying drawings.

DETAILED DESCRIPTION OF THE INVENTION

Reference will now be made in detail to a preferred embodiment of the present invention.

Figure 1:
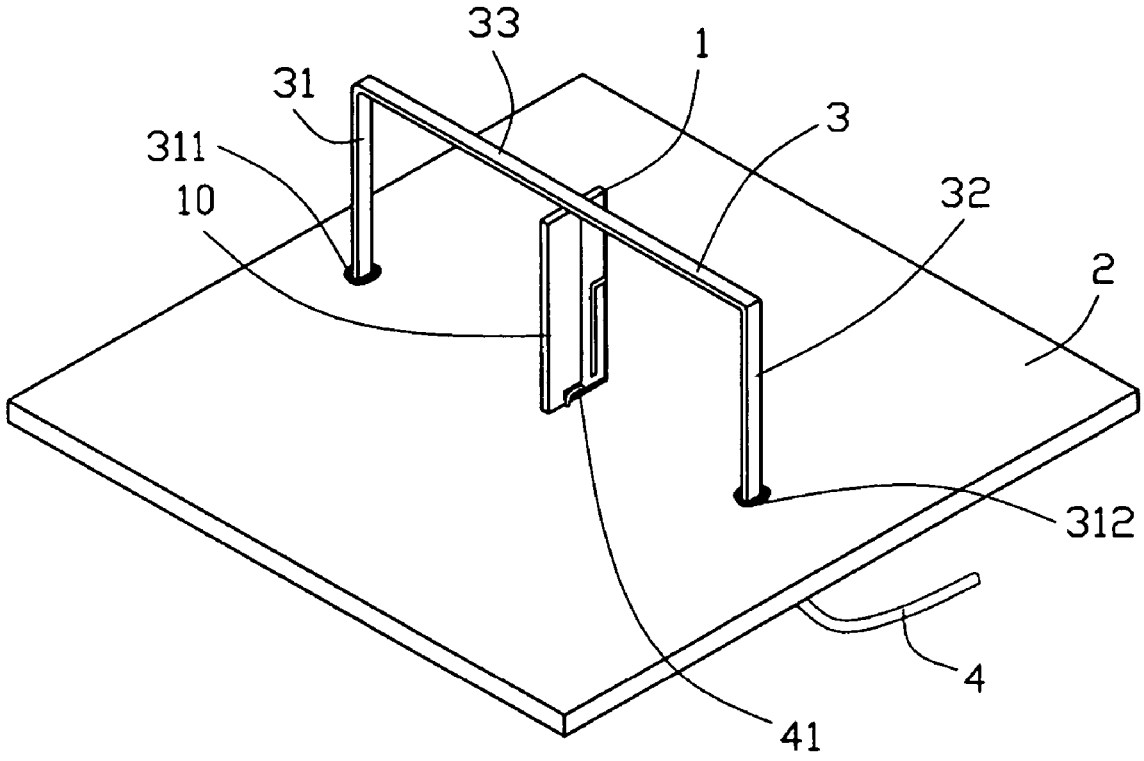
FIG. 1 is a perspective, assembled view of an antenna with an impedance matching means in accordance with a first embodiment of the present invention.

Referring to FIG. 1, an antenna comprises a radiating body 1, a grounding plate 2 and a coaxial cable 4. The radiating body 1 is arranged on the grounding plate 2 and power energy is supplied thereto by the coaxial cable 4. An impedance matching means is realized by a parasitic element 3, which is arranged on the grounding plate 2 as well.

Figure 6:
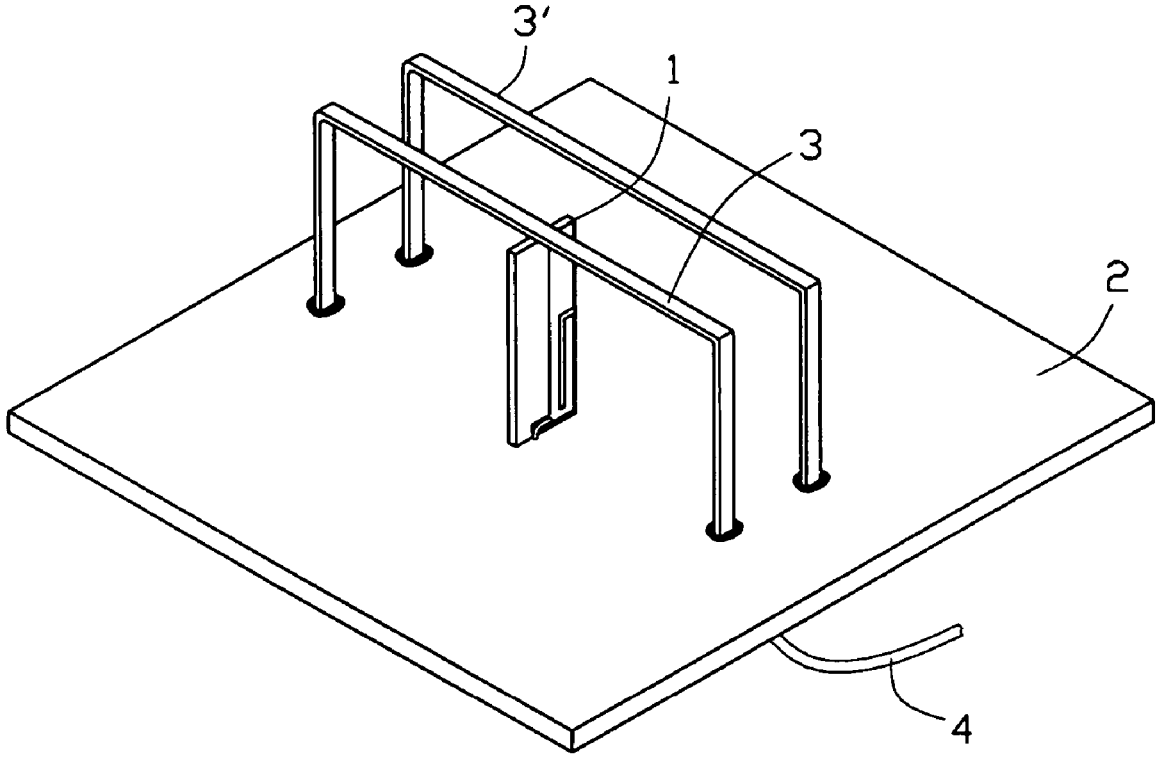

The radiating body 1 is formed of a metal foil fabricated on a dielectric substrate 10 thereof. The dielectric substrate 10 is disposed perpendicularly on the grounding plate 2. The area of the grounding plate 2 is much greater than that of the dielectric substrate 10. In this way, the grounding plate 2 provides a mirror image for the radiating body 1 above it so that it is as if another radiating body 1 is located below the grounding plate 2. The parasitic element 3 positioned on the grounding plate 2 crosses the radiating body 1 and is used to tune an input impedance of the antenna. The parasitic element 3 comprises a first arm 31, a second arm 32, which are orthogonal to the grounding plate 2 and a third arm 33 connected to the first and second arm 31, 32 transversely. The three arms 31, 32, 33 are formed of a narrow metal sheet and constitute a bridge-shaped parasitic element 3 together. The first arm 31 has a first free end 311 electrically coupled to the grounding plate 2, and the second arm has a second free end 321 coupled to the plate 2 likewise. The parasitic element 3 is symmetrically aligned on the grounding plate with respect to the radiating body. In order to achieve impedance matching between the antenna and the cable 4, the locations and dimensions of the parasitic element 3 may need to be adjusted. For example, if an influence for the input impedance of the antenna by the parasitic element 3 is not obvious or enough, we may lay the parasitic element 3 toward the radiating body 1 as close as possible or enhance a narrow width of the parasitic element 3. If the impedance of the antenna appears capacitive, we may increase the length of the third arm 33 of the parasitic element 3 and on the contrary, if the impedance of the antenna appears inductive, we may decrease the length of the third arm 33 of the parasitic element 3. In addition, we may employ more than one parasitic element 3 to adjust the antenna input impedance, as shown in FIG. 6.

Figure 2A:
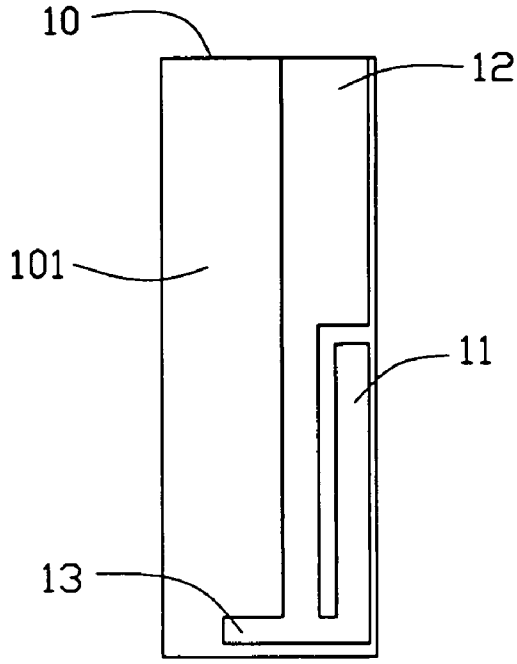
FIG. 2A is obverse view of an radiating body of the antenna of FIG. 1.
Figure 2B:
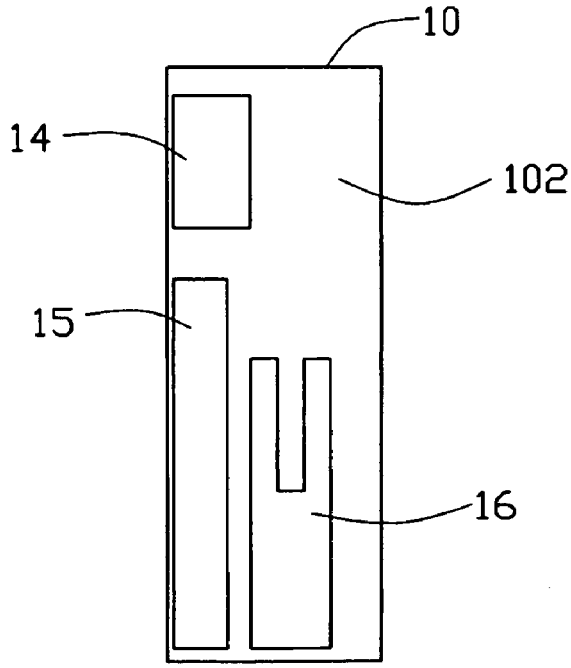
FIG. 2B is a reverse view of the radiating body of FIG. 2A.

As shown in amplificatory views of the antenna radiating body 1 in FIG. 2A and FIG. 2B, the dielectric substrate 10 has a first surface 101 and an opposite second surface 102. The metal foil constitutes a first radiating portion 11, a second radiating portion 12 and a feed portion 13, which are fabricated on the first surface 101 of the dielectric substrate 10. On the second surface 102 of the substrate 10 there disposes a parasitic portion, which is not connected directly with a cable 4 and used for improving the gain of the antenna. The parasitic portion consists of three metal pieces 14, 15, 16 arranged at predetermined locations of the second surface 102 with different sizes. The respective lengths of the radiating portions 11, 12 are selected to be ¼ wavelength of the central frequency of the respective resonant frequencies. The first radiating portion 11 serves to generate a first (higher frequency) resonant frequency and the second radiating portion 12 serves to generate a second (lower frequency) resonant frequency. The radiating portions 11, 12 and the feed portion 13 can be fabricated on the dielectric substrate 10 by means of etching or other techniques. The coaxial cable 4 has an inner conductor 41 and an outer shield conductor, which feeds power energy to the antenna through a hole in the grounding plate 2 with the inner conductor 41 connecting to the feed portion 13 and the outer shield conductor connecting to the grounding plate 2 (not shown).

The foregoing antenna is made only by way of example and not as a limitation to the scope of the invention. Other types of antenna, such as PIFA, dipole antenna, microstrip antenna or the like might be employed in the invention.

Figure 3:
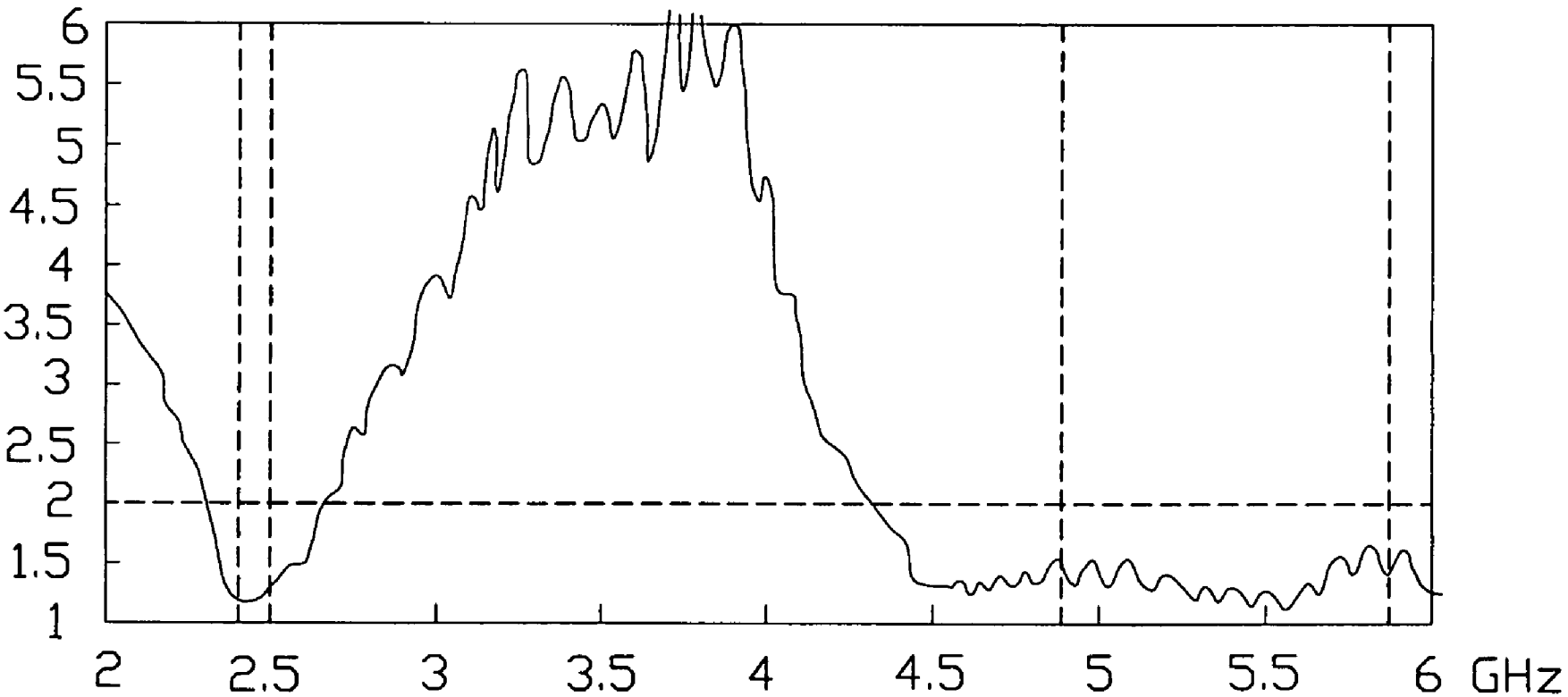
FIG. 3 is a test chart recording for the antenna with the impedance matching means of FIG. 1, showing Voltage Standing Wave Ratio (VSWR) as a function of frequency.

Referring to FIG. 3, the central frequency of the first resonant frequency band is around 2.4 GHz, and that of the second resonant frequency band is around 5.2 GHz. Furthermore, under the definition of the Voltage Standing Wave Ratio (VSWR) less than 2, the bandwidth of the first resonant frequency and that of the second resonant frequency cover 2.3-2.65 GHZ and 4.4-6.0 GHz, respectively. The two frequency bands are so wide that cover the bands (2.4 GHz and 5.2 GHz) for Wireless Local Area Network (WLAN). The VSWR proves that due to the existence of the parasitic element 3, the impedance matching between the antenna and the cable 4 is perfect.

Figure 4:
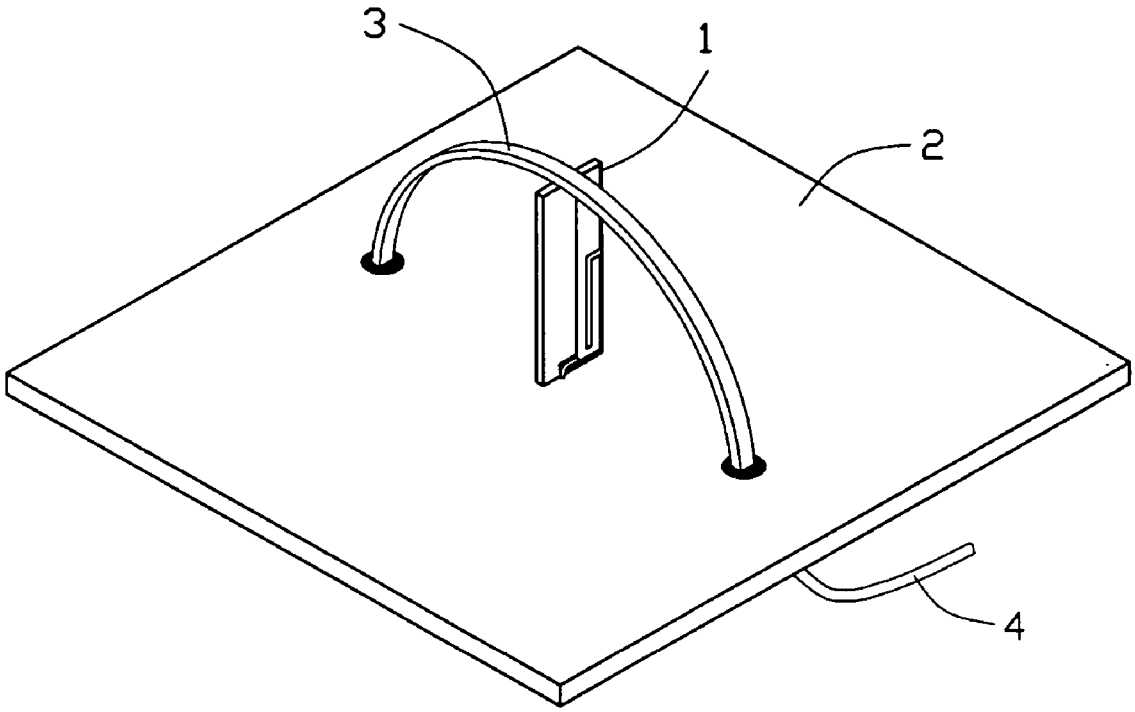
FIGS. 4-6 show different embodiments of the impedance matching means of the invention.
Figure 5:
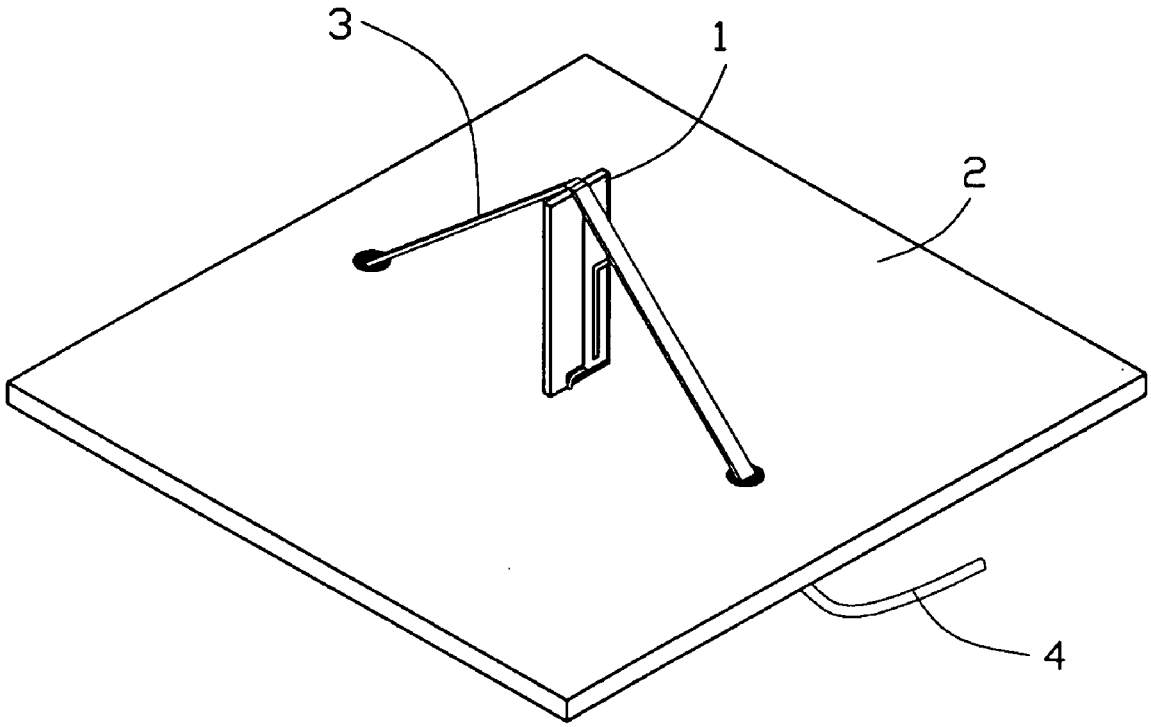

The parasitic element 3 employed as impedance matching means can be other modifications to those skilled in the relevant art. Referring to FIG. 4 and FIG. 5, other two modalities of the parasitic element 3 are suggested. The parasitic element 3 in FIG. 4 is configured as a half-circular arc shape and in FIG. 5 as an inverted-V shape. Referring to FIG. 6, a second parasitic element 3' is employed. Both the parasitic elements 3, 3' are arranged on the grounding plate 2 and parallel to each other.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An impedance matching means for performing impedance matching between an antenna and a transmission line, wherein the antenna comprises a grounding plate, a radiating body arranged on the grounding plate and a transmission line coupled to said radiating body and grounding plate; said impedance matching means comprising a parasitic element having a first and a second ends, wherein said parasitic element is arranged on the grounding plate, and only the first and second ends of the parasitic element electrically connecting to the grounding plate;

wherein the parasitic element comprises a first and a second arms, and a plane defined by said first and second arms is perpendicular to said grounding plate and said radiating body.

2. The impedance matching means according to claim 1, wherein said parasitic element is formed of a narrow metal sheet and configured as a bridge shape.

3. The impedance matching means according to claim 1, wherein said parasitic element comprises a third arm connecting transversely to the first and second arms.

4. The impedance matching means according to claim 1, wherein the dimension and location on the grounding plate of the parasitic element are adjustable for changing an input impedance of the antenna.

5. The impedance matching means according to claim 1, wherein the antenna has a second parasitic element arranged on the grounding plate for impedance matching.

6. The impedance matching means according to claim 5, wherein said second parasitic element has the same dimension and configuration as those of the parasitic element.

7. The impedance matching means according to claim 5, wherein said both parasitic elements are parallel to each other.

8. The impedance matching means according to claim 1, wherein said parasitic element crosses the radiating body.

9. The impedance matching means according to claim 1, wherein the parasitic element is symmetrically aligned on the grounding plate with respect to the radiating body.

10. The impedance matching means according to claim 1, wherein the radiating body is a printed circuit board radiating body and comprises a dielectric substrate having a first surface and an opposite second surface, and radiating portions fabricated on the first surface of the dielectric substrate, and wherein a parasitic radiating portion is fabricated on the second surface of the dielectric substrate without connecting to the transmission line.

11. The impedance matching means according to claim 10, wherein the transmission line is a coaxial cable having an inner conductor and an outer shield conductor, and wherein the inner conductor electrically connects to the radiating element and the outer shield conductor connects to the grounding plate.

12. A method of making an antenna having matched input impedance, comprising the steps of:

(a) providing a ground plate;

(b) providing a radiating body arranged on the grounding plate;

(c) providing a parasitic element arranged on the grounding plate and extending across the radiating body;

wherein the parasitic element is provided with a first and a second arms, and a plane defined by said first and second arms extends perpendicularly to said ground plate and said radiating body; and (d) adjusting dimensions or locations of said parasitic element so as to make the input impedance of the antenna match with that of a transmission line.

13. The method according to claim 12, wherein the parasitic element has at least a point elevating from the grounding plate.

14. An antenna assembly comprising:

an antenna including:

a grounding plate;

a radiating body located on the grounding plate in a non-parallel manner;

a transmission line coupled to the grounding plate and the radiating body, respectively; and an impedance matching device located on the grounding plate and including a parasitic element which electrically connects to the grounding plate and at least partially surrounds the radiating body so as to achieve a desired capacitance/inductance by adjusting a dimension of said parasitic element; wherein the radiating body is formed of a metal foil allied on a dielectric substrate extending in a straight manner while the impedance matching device is not of a straight manner so as to extend over said radiating body.

15. The antenna assembly as claimed in claim 14, wherein the radiating body is essentially located between the grounding plate and the impedance matching device.

16. The antenna assembly as claimed in claim 14, wherein said impedance matching device is symmetrically arranged with regard to the radiating body.

17. The antenna assembly as claimed in claim 14, wherein the radiating body further includes at least one parasitic portion.

18. The antenna assembly as claimed in claim 14, wherein the radiating body extends in a first plane, and the impedance matching device essentially extends in a second plane which is perpendicular to the first plane.

19. The antenna assembly as claimed in claim 14, wherein said radiating body and said impedance matching device intersect each other in a top view of said grounding plate.

20. The antenna assembly as claimed in claim 14, wherein the radiating body is fully seated upon the grounding plate along a bottom edge thereof, while the impedance matching device is seated upon the grounding plate only at two opposite ends thereof.

* * * * *